United States Patent [19]

Hirsch

[11] 4,430,859

[45] Feb. 14, 1984

[54] HYDRAULIC ACCUMULATOR CHARGING CIRCUIT

[75] Inventor: Arthur E. Hirsch, Terre Haute, Ind.

[73] Assignee: J. I. Case Company, Racine, Wis.

[21] Appl. No.: 251,584

[22] Filed: Apr. 6, 1981

[51] Int. Cl.[3] ..... F15B 1/02

[52] U.S. Cl. ..... 60/418; 60/413

[58] Field of Search ..... 60/413, 418, 422; 137/101, 115; 91/5, 516, 518, 532

[56] References Cited

U.S. PATENT DOCUMENTS

| | | | |
|---|---|---|---|
| 2,850,878 | 9/1958 | Sampietro et al. | 60/418 |
| 3,640,301 | 2/1972 | Jania | 60/418 |
| 3,692,039 | 9/1972 | Ewald et al. | 137/115 |
| 4,029,293 | 6/1977 | Meysenburg | 137/115 |
| 4,192,337 | 3/1980 | Alderson et al. | 60/413 |

FOREIGN PATENT DOCUMENTS

| | | | |
|---|---|---|---|
| 1184840 | 3/1970 | United Kingdom . | |
| 2053107 | 2/1981 | United Kingdom | 137/115 |

*Primary Examiner*—Robert E. Garrett
*Assistant Examiner*—Richard L. Klein
*Attorney, Agent, or Firm*—Cullen, Sloman, Cantor, Grauer, Scott & Rutherford

[57] ABSTRACT

A hydraulic circuit and charging valve arrangement is disclosed for charging an accumulator where the accumulator is used to power an additional function such as a brake valve. The accumulator charging circuit is connected to a load sensing power steering circuit including a flow divider that controls the flow of a fixed displacement pump to selectively effect actuation of a power steering motor and an auxiliary device such as a bucket loader or backhoe control valve. The charging circuit includes a pilot operated charging valve which controls the flow divider of the load sensing steering circuit for the purpose of recharging the accumulator. The charging valve includes a valve member that is biased against a coil spring to a neutral position when the accumulator is charged. When the accumulator pressure drops below a preset level, the valve member is shifted thereby permitting fluid flow through the charging valve to the flow divider in the load sensing steering circuit. This results in the buildup of pressure in the hydraulic circuit which recharges the accumulator and shifts the charging valve member back to its neutral position. The charging valve is constructed to effectively raise the reset pressure required to shift the charging valve member back to its neutral position, thereby creating a controlled hysteresis in the operation of the charging valve.

3 Claims, 1 Drawing Figure

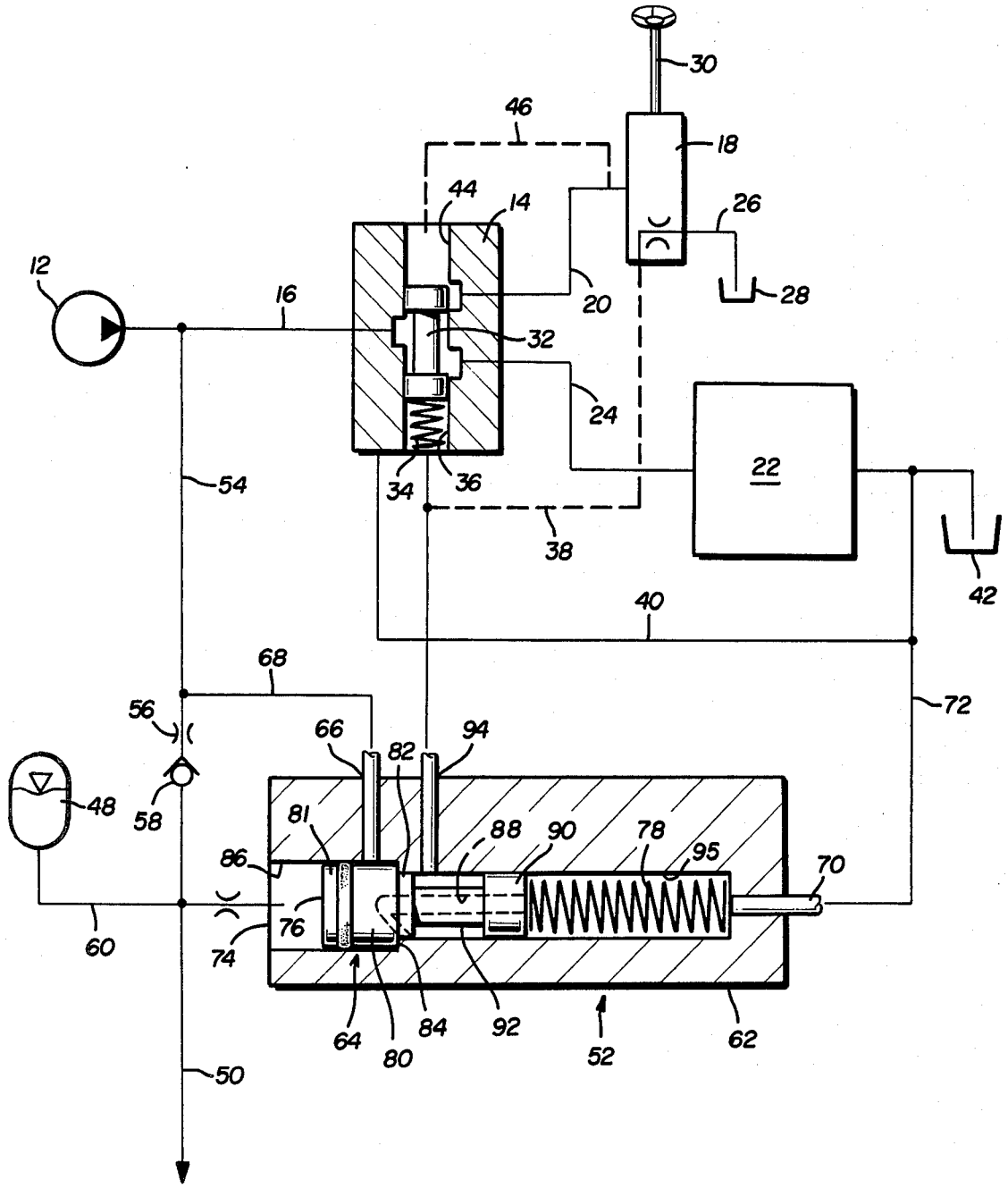
30
46
18
44
14
26
12
16
20
28
32
24
22
54
34
36
38
42
40
68
72
56
66
82
94
48
58
81
88
90
78
95
86
70
60
76
74
64
80
84
92
52
62
50

HYDRAULIC ACCUMULATOR CHARGING CIRCUIT

BACKGROUND OF THE INVENTION

The present invention relates to a hydraulic circuit for charging a hydraulic accumulator where the accumulator is used to power an additional function such as a hydraulic brake valve.

It is conventional to provide an accumulator charging valve which restricts pump flow thereby allowing a part of this flow to be used for the purpose of charging an accumulator when the accumulator pressure drops below a predetermined pressure level. When the accumulator is recharged to a preset level, the charging valve automatically halts the charging of the accumulator and permits unrestricted pump flow.

A disadvantage of known accumulator charging circuits is that the entire pump flow passes through the charging valve which results in the charging valve being relatively large, complex, and expensive. Thus, there has been a need for an improved accumulator charging circuit and charging valve arrangement which eliminates the need for conventional complex and expensive charging valves.

It is also common in earth-working equipment, such as backhoes, loaders and the like, to provide a fluid flow divider between the steering control valve and an auxiliary hydraulic circuit for operating the load handling mechanisms. The interest in steering systems having high pressure carryover capability has been increasing in recognition of the need to use available power sources more efficiently. A hydrostatic power steering system having a high pressure carryover capability makes it possible to operate both the steering motor and an auxiliary device such as a backhoe or loader bucket using only one pump, while converting a greater amount of the input energy to that pump into useful work.

Accordingly, it is an object of the present invention to provide a hydrostatic power steering circuit of the type which is capable of providing pressurized fluid to an auxiliary fluid circuit while giving priority to the demands of the steering circuit. It is a further object of the present invention to include within the hydrostatic power steering circuit an accumulator charging circuit and improved charging valve arrangement where the accumulator is charged to power an additional function such as a hydraulic brake valve.

SUMMARY OF THE INVENTION

In accordance with the present invention, a conventional power steering circuit is provided for controlling the flow of a fixed displacement pump to selectively effect actuation of a power steering motor and an auxiliary device such as a bucket loader or backhoe control valve. The system comprises a steering control valve disposed in series flow relationship between the pump and steering motor. The steering valve includes variable orifice valving which is movable to either a right turn or left turn position, thereby resulting in a predetermined pressure drop occurring across the steering valve.

The hydraulic circuit further includes a priority flow divider disposed in series flow relationship between the pump and the steering control valve. The flow divider includes an inlet port in communication with the pump for receiving substantially all of the system flow, a first discharge port in fluid communication with the steering control valve, and a second discharge port in fluid communication with the loader or backhoe control valve in an auxiliary circuit.

The priority flow divider includes a valve member and a spring biasing the valve member towards a position permitting substantially all of the system flow to pass to the steering control valve through the first discharge port. A load pressure signal is communicated from the downstream side of the steering control valve to exert a biasing force on the flow divider valve member in the same direction as the spring. A pilot pressure signal is taken upstream of the steering control valve and communicated to the flow divider to exert a biasing force on the valve member in opposition to the biasing force of the spring.

Thus, the load pressure and pilot pressure signal lines provide opposing pressure signals across the ends of the flow divider valve member that represent the pressure drop across the steering valve. By maintaining a constant pressure drop from the steering valve inlet to load, steering flow depends on the setting of the metering orifices within the steering valve and not on load pressure.

The present invention provides for the charging of an accumulator as a separate function which in no way interferes with the operation of the power steering for the machine. The charging circuit is connected to the hydrostatic steering circuit and includes a small pilot operated spool charging valve which controls the flow divider of the load sensing steering system under certain circumstances for the purpose of recharging an accumulator. The charging valve includes an inlet port connected to the fixed displacement pump of the steering circuit and a discharge port connected to a tank or reservoir. The fluid pressure in the accumulator is communicated to one end of the charging valve to bias a spool valve member therein against a coil spring.

The spool valve member includes an enlarged cylindrical portion at one end having concentric surfaces separated by an annular step. When the charging valve is in its neutral or non-actuated position, the annular step and outer peripheral surfaces of the enlarged cylindrical portion sealingly engage a complementary stepped interior bore of the valve housing to prevent fluid flow into an orifice which passes through the valve member.

If the accumulator is charged, the spool valve member is biased against the coil spring such that the enlarged cylindrical end portion blocks fluid from entering the charging valve. In this position, the force of the coil spring against one end of the spool valve member is counteracted by the accumulator pressure acting on the opposite end of the valve member.

If the accumulator pressure drops below a preset level, the spool valve member shifts such that the annular step on the enlarged cylindrical portion passes under the inlet port to the charging valve thereby permitting fluid flow from the pump to enter the charging valve. This results in the communication of fluid flow from the pump to the load sensing line of the priority flow divider which causes a build-up of pressure in the conduit between the flow divider and the pump and in the flow divider until steering relief pressure is reached as determined by the relief valve in the flow divider. Under these conditions, the increased pressure at the pump is communicated to the accumulator through a check valve to recharge the accumulator. After the accumulator becomes recharged, the spool valve member is shifted back to its neutral or non-actuated position to once again block the inlet port to the charging valve thereby returning the system to its normal operation.

The charging spool valve member is shifted to permit recharging of the accumulator when the pump does not come up to full pressure often enough which may occur when the loader or backhoe machine is being powered for transport purposes. During a working cycle of the loader or backhoe implement, the pressure at the pump normally exceeds the accumulator pressure and the accumulator is charged without the intervention of the charging valve.

An important feature of the present invention results from the construction of the charging valve which effectively raises the reset pressure necessary for the spool valve member thereby creating a controlled hysteresis in the operation of the charging valve. That is, the spool valve member will shift when the accumulator pressure drops to, for example, 1700 PSI but will not shift back to its non-actuated position until the accumulator has recharged to, for example, 2200 PSI.

When the spool valve member shifts in response to the decrease in accumulator pressure, fluid flow from the pump enters the charging valve inlet port and is partially discharged to a reservoir through an orifice in the enlarged end portion of the spool valve member. This results in fluid pressure being applied to the annular step on the enlarged end portion of the spool valve member which is equal to the pump pressure. The fluid pressure acting on the annular step results in a force counteracting accumulator pressure that is in addition to the counteracting force of the coil spring acting against one end of the spool valve member. Thus, the accumulator must be recharged to a pressure that exceeds the combined counteracting forces from the coil spring and the fluid force on the annular step before the spool valve member can be returned to its non-actuated position. This effectively raises the reset pressure required to shift the spool valve member to its neutral position.

Other advantages and meritorious features of the hydraulic accumulator charging circuit of the present invention will be more fully understood from the following description of the preferred embodiment, the appended claims, and the drawing, a brief description of which follows.

BRIEF DESCRIPTION OF DRAWING

The single FIGURE drawing is a schematic illustration of the hydraulic accumulator charging circuit of the present invention.

DETAILED DESCRIPTION OF THE INVENTION

A preferred embodiment of the hydraulic accumulator charging circuit is illustrated in the single FIGURE drawing.

The drawing illustrates schematically a hydrostatic power steering circuit including a fixed displacement pump 12 which provides hydraulic fluid at a constant flow and variable pressure to a priority flow divider 14 through fluid conduit 16. The priority flow divider is hydraulically connected between pump 12 and steering valve 18 for the steering circuit. Pump 12 is connected to a reservoir (not shown) and supplies hydraulic fluid under pressure to priority flow divider 14 which directs fluid flow to either steering valve 18 through conduit 20 or to a loader control valve 22 for an auxiliary circuit through conduit 24.

Steering control valve 18 is of a type well known in the art for controlling the flow and direction of pressurized fluid to a steering cylinder (not shown) for control of ground engaging wheels. The steering control valve 18 includes a fluid inlet conduit 20 and a fluid return conduit 26 connected to reservoir 28. Disposed within valve 18 is a valving arrangement which is movable from a neutral position to either a right turn or a left turn position in response to rotation of steering wheel 30 by the operator. The valving arrangement may include a spool and sleeve, as is conventional, to define various control orifices which vary in size in response to a combination of relative axial and rotational movement between the spool and sleeve thereby controlling the steering flow rate. Thus, the rate of rotation of steering wheel 30 determines the rate of flow of fluid to the steering cylinder through the variable orifice established by the steering valve 18.

Substantially all of the output of pump 12 is fed to pilot operated priority flow divider 14 which provides a variably restricted flow to steering valve 18 through conduit 20 and provides a variably restricted flow through conduit 24 to the loader control valve 22 of an auxiliary fluid circuit. Flow divider 14 includes a valve member 32 which is biased by coil spring 34 toward a position permitting substantially all of the fluid flow from pump 12 to pass to conduit 20. A fluid pressure signal is communicated to flow divider port 36 from the steering valve 18 by load sensing line 38 to bias valve member 32 in the same direction as the biasing force from spring 34. The load sensing line also communicates with a conventional steering relief valve (not shown) in flow divider 14, the outlet side of which is communicated by fluid conduit 40 back to tank 42.

A pressure signal is also communicated back to flow divider port 44 by means of a pilot signal line 46 to exert a biasing force on valve member 32 in opposition to that exerted by spring 34. Thus, signal lines 38 and 46 communicate pressure signals from downstream and upstream of the variable orifice created by steering valve 18 to provide opposing pressure signals across the ends of valve member 32 that represent the pressure drop across the steering valve. As a result, any change in the steering load causes the valve member 32 of flow divider 14 to shift and adjust the fluid pressure fed to the steering valve 18 to maintain a predetermined pressure drop across valve 18 from steering valve inlet to load pressure. By maintaining a constant pressure drop from the steering valve inlet to load, steering flow depends only on the metering orifice size within valve 18 and not on load pressure.

As described, the present invention relates to the charging of hydraulic accumulator 48 so that it may be used to power an additional function such as a brake valve (not shown) through fluid conduit 50. Conventional accumulator charging valves are designed such that the entire pump flow passes through them thereby making them large, relatively complex, and expensive. The present invention eliminates prior charging valves by providing a small pilot operated spool valve 52 to control flow divider 14 of the load sensing steering system under certain circumstances as will be described.

The charging of accumulator 48 is a separate function which in no way interferes with the operation of the power steering for the machine. It should also be noted that the present hydraulic circuit is for a fixed displacement pump 12 and is not applicable to a closed center variable displacement pump employing a high pressure standby. During a normal working cycle where, for example, the auxiliary circuit loader valve 22 is under load and the pump pressure exceeds the pressure in accumulator 48, there would be fluid flow through conduit 54, orifice 56, check valve 58, and conduit 60 to charge accumulator 48 up to pump pressure. Thus, in a norml working cycle, accumulator 48 is kept charged without the intervention of charging valve 52.

Charging valve 52 includes a housing 62 having a slidable spool valve member 64 therein. Housing 62 further includes an inlet port 66 connected to pump 12 by conduit 68 and a discharge port 70 connected to tank 42 by conduit 72. The fluid pressure in accumulator 48 is communicated to charging valve port 74 and valve member end 76 to bias the valve member 64 against coil spring 78.

Valve member 64 includes an enlarged cylindrical portion 80 having concentric surfaces 81 and 82 separated by an annular step 84. When the charging valve 52 is in its neutral or non-actuated position as illustrated in the drawing, annular step 84 and the outer peripheral surfaces 81 and 82 of portion 80 sealingly engage the complementary stepped interior bore 86 of housing 62 to prevent fluid flow into orifice 88 which passes through valve member 64. Valve member 64 also includes enlarged cylindrical portion 90 which sealingly engages bore 95 and which is separated from cylindrical portion 80 by a recessed connection portion 92.

When the accumulator is charged, as illustrated in the drawing, valve member 64 is biased against spring 78 such that the annular surface 81 blocks fluid from entering inlet 66 and being discharged through orifice 88. In this position, the pressure at annular step surface 84 is equal to the pressure at discharge port 70, and the force of spring 78 against one end of valve member 64 is counteracted by the accumulator pressure acting on the other end 76 of member 64. Orifice 88 allows any leakage from inlet port 66, annular surface 81, or port 94 to be discharged to port 70 thereby insuring that annular step 84 remains at the pressure of discharge port 70.

When the accumulator pressure drops below a preset level, spool valve member 64 shifts to the left as viewed in the drawing and annular step 84 passes under inlet port 66 thereby permitting fluid flow from pump 12 to be discharged from charging valve 52 through charging valve port 94. This causes the fluid flow from pump 12 to be communicated to the load sensing line 38 which results in the build-up of pressure in conduit 16 and in flow divider 14 until steering relief pressure is reached as determined by the relief valve in flow divider 14. Under these conditions, the increased pressure in conduit 16 is communicated to accumulator 48 through check valve 58 and conduit 60 to recharge accumulator 48. After accumulator 48 becomes recharged, charging valve member 64 is shifted to its neutral or non-actuated position as illustrated in the drawing to once again block inlet port 66 thereby returning the system to its normal operation.

Charging valve member 64 is shifted to permit recharging of accumulator 48 when pump 12 does not come up to full pressure often enough which may occur when the wheeled loader or backhoe machine is being powered for transport purposes. During a working cycle of the loader or backhoe implement, the pressure at pump 12 normally exceeds accumulator pressure and the accumulator is charged without the intervention of charging valve 52.

An important feature of the present invention results from the construction of charging valve 52 which effectively raises the reset pressure necessary for valve member 64, thereby creating a controlled hysteresis in the operation of valve 52. That is, valve member 64 will shift when the accumulator pressure drops to, for example, 1700 PSI but will not shift back to its non-actuated position until the accumulator has recharged to, for example, 2200 PSI. When valve member 64 shifts to the left as viewed in the drawing in response to the decrease in accumulator pressure, fluid flow from pump 12 enters through charging valve port 66 and is discharged through port 94. Thus, fluid from pump 12 flows past recessed connection 92 to port 94 which results in fluid pressure being applied to annular surface 82 and annular step 84 equal to the pump pressure. Further, fluid pressure is discharged through orifice 88, but orifice 88 is small and the leakage flow through it to discharge port 70 is kept to a minimum.

The fluid pressure acting on the annular surface 82 and step 84 results in a force counteracting accumulator pressure on valve member end 76 that is in addition to the counteracting force of spring 78. Thus, the accumulator must be recharged to a presssure that exceeds the combined counteracting forces from spring 78 and the fluid force on annular step 84 before valve member 64 can be returned to its non-actuated position. This effectively raises the reset pressure required to shift valve member 64 to its neutral position.

It will be apparent to those skilled in the art that the foregoing disclosure is exemplary in nature rather than limiting, the invention being limited only by the appended claims.

I claim:

1. A hydraulic circuit for charging an accumulator, said hydraulic circuit comprising:

a fixed displacement pump in fluid communication with said accumulator for charging said accumulator to a preset pressure level;

a steering control valve disposed in series flow relationship between said pump and a steering motor;

a priority flow divider disposed in series flow relationship between said pump and said steering control valve, said flow divider including an inlet port in communication with said pump, a first discharge port in fluid communication with said steering control valve, and a second dicharge port in fluid communication with an auxiliary circuit, said flow divider including valve means to control fluid flow from said inlet port to said discharge ports, and means biasing said valve means toward a position permitting substantially all of the fluid flow to pass from said inlet port to said first discharge port;

means for communicating a load pressure signal from downstream of said steering control valve to exert a biasing force on said valve means in the same direction as said biasing means and means communicating a pilot pressure signal from upstream of said steering control valve to exert a biasing force on said valve means in opposition to said biasing means, and said load pressure signal being in fluid communication with a steering relief means in said flow divider; and a charging valve including a valve member, an inlet port in fluid communication with said pump, a first outlet port in fluid communication with said load pressure signal means, and a second outlet port in communication with a reservoir, the fluid pressure in said accumulator being communicated to one end of said valve member to bias said valve member to a neutral position against a spring means at the other end of said valve member to prevent fluid flow into said charging valve through said charging valve inlet port when said accumulator is charged to said preset pressure level, and said valve member being shifted away from said neutral position by said spring means in response to the accumulator pressure dropping below said preset level to permit fluid flow from said pump to enter said inlet port in said charging valve and be discharged through said first outlet port to said flow divider whereby a pressure buildup occurs at said flow divider and said pump which is communicated to said accumulator to recharge said accumulator and shift said valve member back to its neutral position.

2. The hydraulic circuit as defined in claim 1 wherein said valve member includes an end portion having concentric peripheral surfaces separated by an annular step, said peripheral surfaces and annular step sealingly engaging a complementary interior bore within said charging valve to prevent fluid flow into said charging valve when said valve member is in its neutral position.

3. The hydraulic circuit as defined in claim 2 wherein said valve member end portion includes an orifice passing therethrough that terminates at one end adjacent said annular step, said orifice being in fluid communication at its other end with said second outlet port from said charging valve, a small amount of fluid flow at pump pressure passing through said orifice when said valve member is shifted by said spring means away from said neutral position in response to the accumulator pressure dropping below said preset level, and said fluid flow at pump pressure acting upon said annular step thereby causing a force against said annular step counteracting accumulator pressure in addition to the counteracting force of said spring means against said valve member, and said orifice allowing leakage flow past said peripheral surfaces to flow to said second outlet port when said valve member is in said neutral position.

* * * * *